US012643013B1

(12) United States Patent
Shakir

(10) Patent No.: US 12,643,013 B1
(45) Date of Patent: Jun. 2, 2026

(54) PROGRAMMABLE WEIGHT MOVEMENT TRACKING DEVICE

(71) Applicant: Rafiq Shakir, Dallas, TX (US)

(72) Inventor: Rafiq Shakir, Dallas, TX (US)

( * ) Notice: Subject to any disclaimer, the term of this patent is extended or adjusted under 35 U.S.C. 154(b) by 0 days.

(21) Appl. No.: 19/196,614

(22) Filed: May 1, 2025

(51) Int. Cl.
*A63B 24/00* (2006.01)
*A63B 71/06* (2006.01)

(52) U.S. Cl.
CPC ..... *A63B 24/0062* (2013.01); *A63B 71/0622* (2013.01); *A63B 2024/0065* (2013.01); *A63B 2220/805* (2013.01); *A63B 2225/093* (2013.01)

(58) Field of Classification Search
CPC ..... A63B 24/0062; A63B 71/0622; A63B 2024/0065; A63B 2220/805; A63B 2225/093
See application file for complete search history.

(56) References Cited

U.S. PATENT DOCUMENTS 7,455,621 B1 * 11/2008 Anthony ..... A63B 24/0062 482/3
7,666,118 B1 * 2/2010 Anthony ..... A63B 21/0724 482/8
8,105,207 B1 * 1/2012 Lannon ..... A63B 23/03566 482/901
2018/0345080 A1 * 12/2018 Orfield ..... A61B 5/224
2023/0026251 A1 * 1/2023 Tracy ..... F16M 11/105
2024/0359048 A1 * 10/2024 Campanaro ..... A63B 22/205

* cited by examiner

*Primary Examiner* — Francis C Gray

(74) *Attorney, Agent, or Firm* — Pharar Patents & Intellectual Property; Andrew A. Pharar

(57) ABSTRACT

The programmable weight movement tracking device may overcome the limitations of conventional fitness movement tracking devices. The device may function as an auxiliary unit that can be used in conjunction with any cable machine. An ideal device would combine the portability of fitness tracking devices with ease of operation and programming, all while maintaining a high degree of precision and versatility in a wide range of applications and devices. The device may comprise an array of optical sensors that allow for the precise tracking of particular movements. The device may further comprise a plurality of components to improve the precision and functionality of the device such as, for example, a top, mid-body, and bottom profile structure, a controller unit, a bottom base, a plurality of sensor units, a universal serial bus (USB) receiver, and/or an outer case.

9 Claims, 18 Drawing Sheets

PROGRAMMABLE WEIGHT MOVEMENT TRACKING DEVICE

TECHNICAL FIELD OF THE INVENTION

The present invention relates in general to exercise equipment, and, more specifically, to a programmable weight movement tracking device.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

The present invention relates to tracking devices, and more particularly, to a programmable weight movement tracking device that allows for customizable and dynamic tracking of movement in various environments and applications.

Tracking devices are increasingly utilized in a variety of fields, including sports, fitness, healthcare, industrial automation, robotics, and entertainment, to monitor, analyze, and record movement patterns, frequencies, and loads over time. These devices typically use sensors such as accelerometers, optical sensors, gyroscopes, and global positioning systems (GPS) to detect and record the motion of a user, object, or vehicle. In many cases, tracking devices are designed to provide a one-size-fits-all solution, which may not offer the flexibility or precision required for specialized or dynamic tasks.

Current tracking devices are often limited by their inability to adapt to the specific needs of users or environments. For example, existing tracking systems may provide data on movement along predefined paths or for specific applications without the capability for real-time programmability. While some advanced systems offer programmable tracking, these solutions tend to be complex, requiring specialized programming knowledge or a lack of user-friendly interfaces.

In addition, many conventional movement tracking devices are limited in their ability to adjust to different contexts and varying conditions. For instance, devices designed for motion capture in entertainment or simulation environments may not easily accommodate changes in the tracked object's movement parameters such as variability in object parameters tracked. Similarly, fitness tracking devices may not fully account for specific fitness activities or user needs, such as custom workout routines or different mechanical parameters.

Standard cable machines do not have the mechanism to record and program a user's weightlifting sessions, which leaves exercise fanatics with the task of having to record and track each weightlifting session manually. There exist cable machines that track users' weightlifting sessions but they are not easily portable and programmable and come at a large cost to the user.

Thus, there is a need in the art for a programmable weight movement tracking device that may overcome the limitations of conventional fitness movement tracking devices. The device may function as an auxiliary unit that can be used in conjunction with any cable machine. An ideal device would combine the portability of fitness tracking devices with ease of operation and programming, all while maintaining a high degree of precision and versatility in a wide range of applications and devices. The device may comprise an array of optical sensors that allow for the precise tracking of particular movements. The device may further comprise a plurality of components to improve the precision and functionality of the device such as, for example, a top, mid-body, and bottom profile structure, a controller unit, a bottom base, a plurality of sensor units, a universal serial bus (USB) receiver, and/or an outer case. It is to these ends that the present invention has been developed.

BRIEF SUMMARY OF THE INVENTION

To minimize the limitations in the prior art, and to minimize other limitations that will be apparent upon reading and understanding the present specification, the present invention describes a programmable weight movement tracking device.

It is an objective of the present invention to provide a programmable weight movement tracking device that may comprise a main body.

It is another objective of the present invention to provide a programmable weight movement tracking device that may comprise a base.

It is another objective of the present invention to provide a programmable weight movement tracking device that may comprise a vertical support.

It is another objective of the present invention to provide a programmable weight movement tracking device that may comprise a plurality of optical sensors.

It is another objective of the present invention to provide a programmable weight movement tracking device that may comprise an electronics bank.

It is another objective of the present invention to provide a programmable weight movement tracking device that may comprise a top sensor It is another objective of the present invention to provide a programmable weight movement tracking device that may comprise a universal serial bus (USB) receiver.

It is another objective of the present invention to provide a programmable weight movement tracking device that may comprise an external cover.

It is another objective of the present invention to provide a programmable weight movement tracking device that may comprise a secondary arm.

It is another objective of the present invention to provide a programmable weight movement tracking device that may comprise a height adjuster.

It is another objective of the present invention to provide a programmable weight movement tracking device that may comprise a telescoping mechanism.

It is another objective of the present invention to provide a programmable weight movement tracking device that may comprise a sensor plate.

It is another objective of the present invention to provide a programmable weight movement tracking device that may comprise a proprietary software.

It is another objective of the present invention to provide a programmable weight movement tracking device that may comprise a control panel.

It is another objective of the present invention to provide a programmable weight movement tracking device that may comprise an audiovisual alarm.

It is another objective of the present invention to provide a programmable weight movement tracking device that may comprise a display device.

It is another objective of the present invention to provide a programmable weight movement tracking device that may comprise a resilient material of construction.

It is another objective of the present invention to provide a programmable weight movement tracking device that may comprise a water-proof material of construction.

It is another objective of the present invention to provide a programmable weight movement tracking device that may comprise a reusable material of construction.

It is another objective of the present invention to provide a programmable weight movement tracking device that may comprise a washable material of construction.

It is another objective of the present invention to provide a programmable weight movement tracking device that may comprise a multi-component construction.

It is another objective of the present invention to provide a programmable weight movement tracking device that may comprise an antimicrobial layer.

It is another objective of the present invention to provide a programmable weight movement tracking device that may comprise an antimicrobial material of construction.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

DETAILED DESCRIPTION OF THE INVENTION

Figure 1:
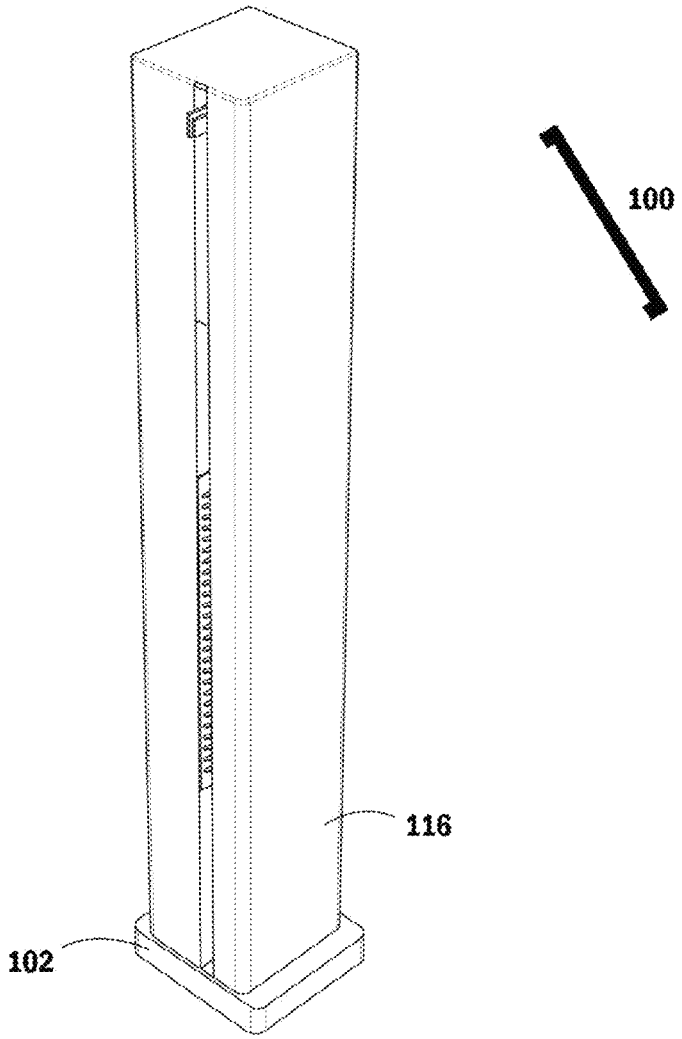
FIG. 1 is an isometric perspective view of a programmable weight movement tracking device with external cover, as contemplated by the present disclosure.
Figure 2:
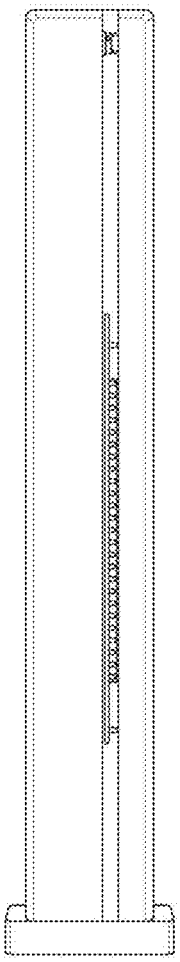
FIG. 2 is a front elevation view of a programmable weight movement tracking device with external cover, as contemplated by the present disclosure.
Figure 3:
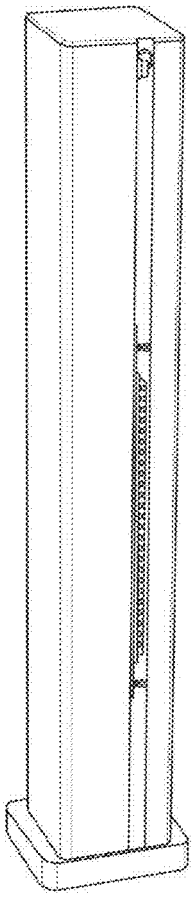
FIG. 3 is an isometric perspective view of a programmable weight movement tracking device with external cover, as contemplated by the present disclosure.
Figure 4:
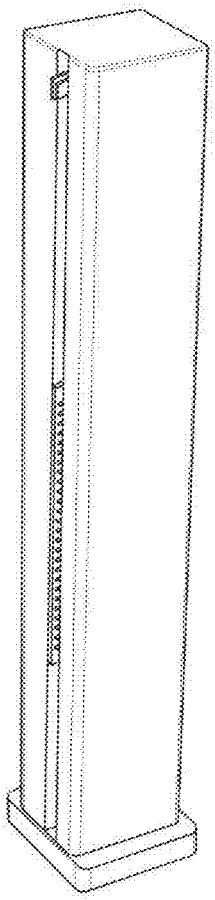
FIG. 4 is an isometric perspective view of a programmable weight movement tracking device with external cover, as contemplated by the present disclosure.
Figure 5:
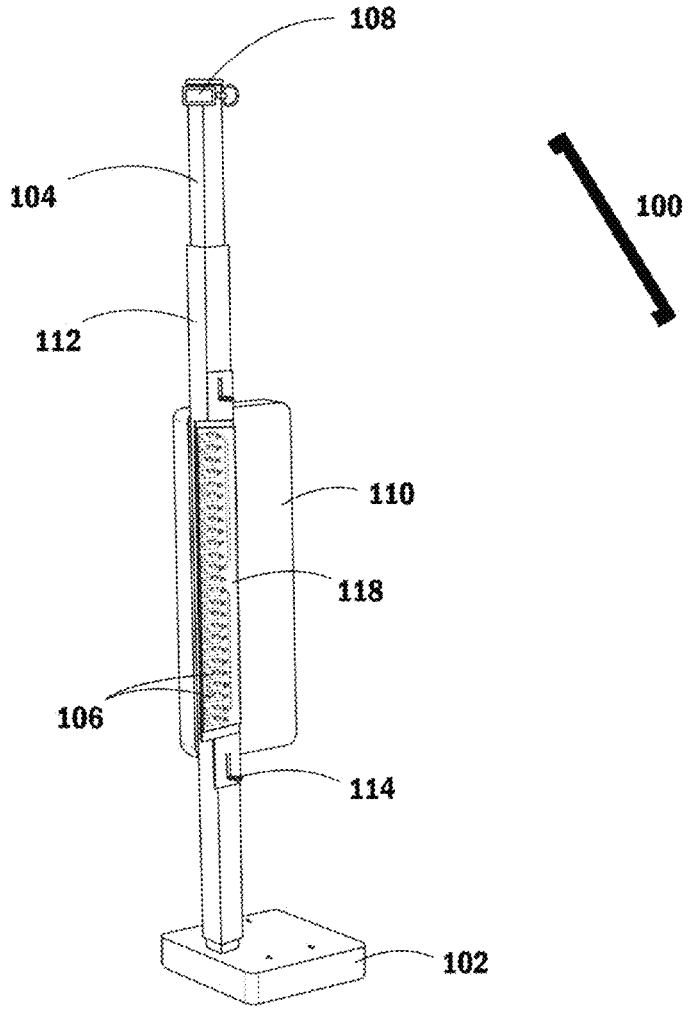
FIG. 5 is an isometric perspective view of a programmable weight movement tracking device mechanism, as contemplated by the present disclosure.
Figure 6:
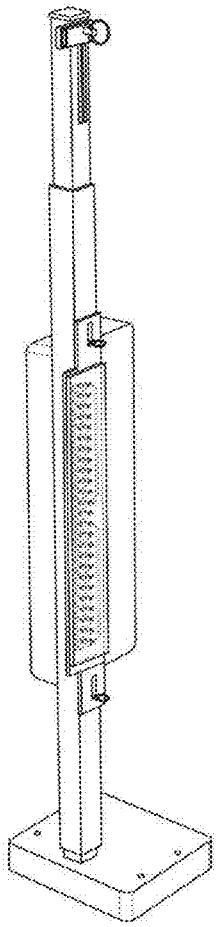
FIG. 6 is an isometric perspective view of a programmable weight movement tracking device mechanism, as contemplated by the present disclosure.
Figure 7:
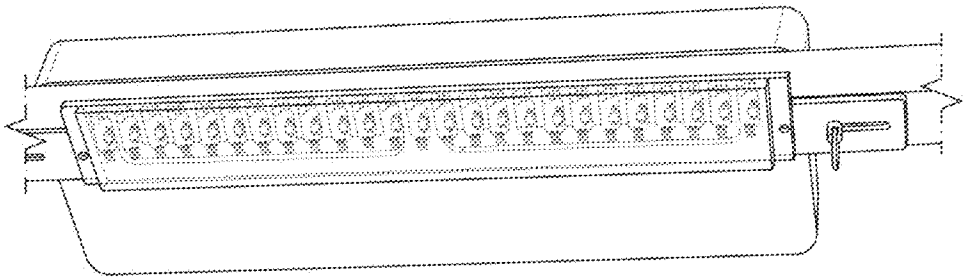
FIG. 7 is a close-up view of a programmable weight movement tracking device optical sensor and electronics bank combination, as contemplated by the present disclosure.
Figure 8:
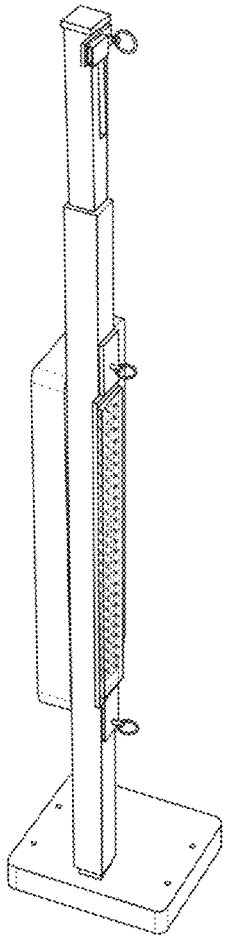
FIG. 8 is an isometric perspective view of a programmable weight movement tracking device mechanism, as contemplated by the present disclosure.
Figure 9:
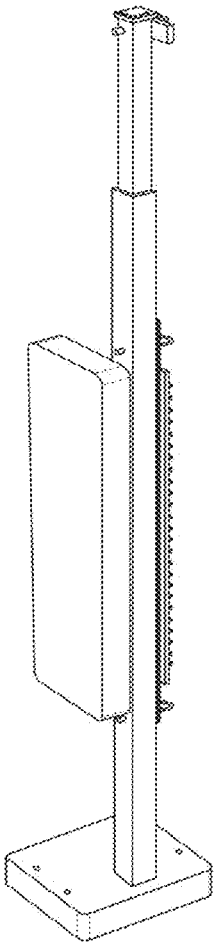
FIG. 9 is an isometric perspective view of a programmable weight movement tracking device mechanism, as contemplated by the present disclosure.
Figure 10:
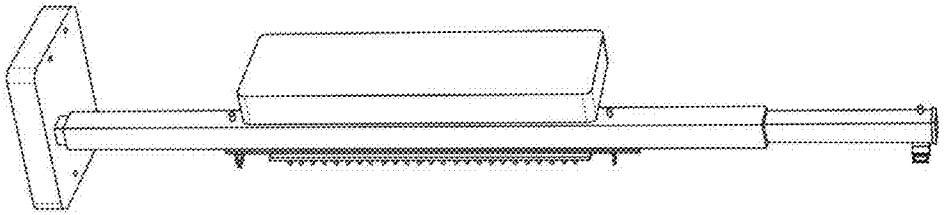
FIG. 10 is an isometric perspective view of a programmable weight movement tracking device mechanism, as contemplated by the present disclosure.
Figure 11:
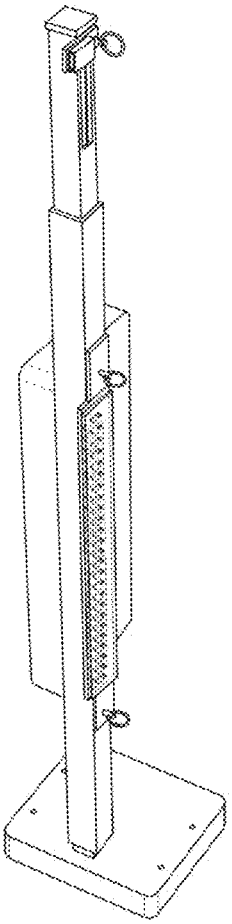
FIG. 11 is an isometric perspective view of a programmable weight movement tracking device mechanism, as contemplated by the present disclosure.
Figure 12:
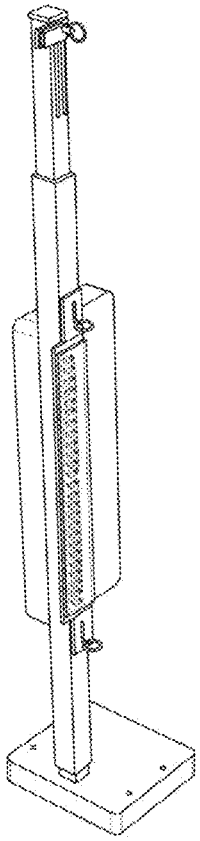
FIG. 12 is an isometric perspective view of a programmable weight movement tracking device mechanism, as contemplated by the present disclosure.
Figure 13:
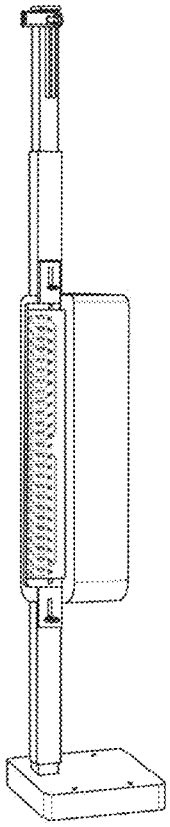
FIG. 13 is an isometric perspective view of a programmable weight movement tracking device mechanism, as contemplated by the present disclosure.
Figure 14:
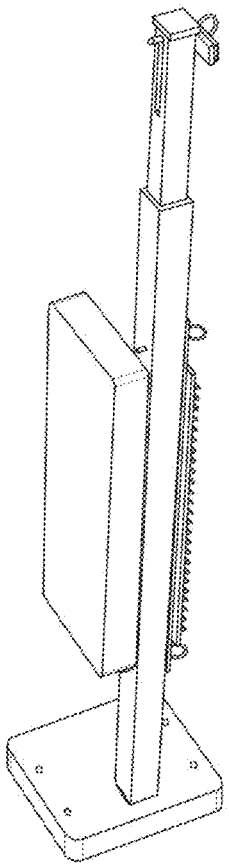
FIG. 14 is an isometric perspective view of a programmable weight movement tracking device mechanism, as contemplated by the present disclosure.
Figure 15:
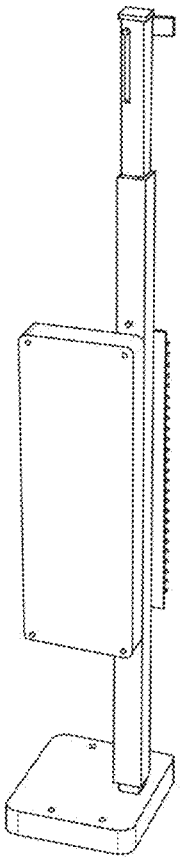
FIG. 15 is an isometric perspective view of a programmable weight movement tracking device mechanism, as contemplated by the present disclosure.
Figure 16:
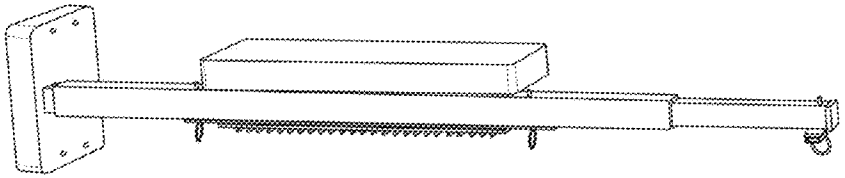
FIG. 16 is an isometric perspective view of a programmable weight movement tracking device mechanism, as contemplated by the present disclosure.

Certain terminology is used in the following description for reference only and is not limiting. The words "front," "rear," "anterior," "posterior," "lateral," "medial," "upper," "lower," "outer," "inner," and "interior" refer to directions toward and away from, respectively, the geometric center of the invention, and designated parts thereof, in accordance with the present disclosure. Unless specifically set forth herein, the terms "a," "an," and "the" are not limited to one element, but instead should be read as meaning "at least one." The terminology includes the words noted above, derivatives thereof, and words of similar import.

The programmable weight movement tracking device may overcome the limitations of conventional fitness movement tracking devices. The device may function as an auxiliary unit that can be used in conjunction with any cable machine. An ideal device would combine the portability of fitness tracking devices with ease of operation and programming, all while maintaining a high degree of precision and versatility in a wide range of applications and devices. The device may comprise an array of optical sensors that allow for the precise tracking of particular movements. The device may further comprise a plurality of components to improve the precision and functionality of the device such as, for example, a top, mid-body, and bottom profile structure, a controller unit, a bottom base, a plurality of sensor units, a universal serial bus (USB) receiver, and/or an outer case.

The illustrations of FIGS. 1-18 illustrate a programmable weight movement tracking device, as contemplated by the present disclosure. The device may comprise, generally, a main body 100 comprising a base 102, a vertical support 104, a plurality of optical sensors 106, and an electronics bank 110.

The base 102 may comprise, generally, any appropriate structural base suitable for supporting the device such as, for example, a block, a plate, a pad, a plurality of legs, or any other similar structure. The base 102 may further comprise an upper side and a lower side. The lower side of the base 102 may further comprise a plurality of foot pads, non-slip pads, casters, rollers, wheels, or any other similar structure. The upper side of the base 102 may further comprise an attachment point for a vertical support 104.

The vertical support 104 may comprise, generally, any appropriate structural support suitable for vertically supporting the various components of the present device such as, for example, a rod, a bar, a post, a pole, or any other similar structure. The vertical support 104 may further comprise an upper side and a lower side. The lower side of the vertical support 104 may further comprise an attachment point for the base 102. The attachment of the base 102 to the vertical support 104 may allow the vertical support 104 to remain in a vertical orientation supported by the base 102.

The plurality of optical sensors 106 may comprise, generally, any appropriate sensors suitable for detecting the presence or absence of an object such as, for example, photoelectric sensors, fiber optic sensors, optical bridge sensors, polarized light sensors, or any other similar device. The plurality of optical sensors 106 may further comprise a matrix of sensors such that they may detect a plurality of objects adjacent to one another. By way of example, the plurality of optical sensors 106 may comprise a linear matrix of optical sensors such that one each of the sensors may detect one each of a plurality of weight plates on a cable machine.

The electronics bank 110 may comprise, generally, any appropriate combination of electronics suitable for controlling the device such as, for example, a central processing unit, a motherboard, a wireless connectivity device, a random-access memory, or any other similar component. The electronics bank 110 may receive a plurality of inputs from the plurality of optical sensors 106 so that the device may detect movement in a plurality of weight plates on a cable machine based on changes in signals from the sensors. The electronics bank 110 may interact wirelessly with a proprietary software application and a central database for data transfer and recording, and to manage user accounts and exercise details.

The programmable weight movement tracking device may further comprise a top sensor 108, which may comprise an additional optical sensor separate from the plurality of optical sensors 106. The top sensor 108 may comprise, generally, any appropriate sensors suitable for detecting the presence or absence of an object such as, for example, photoelectric sensors, fiber optic sensors, optical bridge sensors, polarized light sensors, or any other similar device.

The programmable weight movement tracking device may further comprise a secondary arm 112, which may comprise any appropriate structural support suitable for vertically raising or lowering the various components of the present device such as, for example, a rod, a bar, a post, a pole, or any other similar structure. The secondary arm 112 may comprise a form factor suitable for allowing the secondary arm 112 to telescope relative to the vertical support 102. The secondary arm 112 may be reversibly attached to the vertical support 104 by a plurality of height adjusters 114, which may lock and unlock the secondary arm 112 from the vertical support 104.

The plurality of optical sensors 106 may be further attached to a sensor plate 118. The sensor plate may comprise any appropriate structural component suitable for supporting the plurality of optical sensors 106 and may be attached to the vertical support 104 or the secondary arm 112

The programmable weight movement tracking device may further comprise an external cover 116. The external cover 116 may comprise any protective component suitable for covering and protecting the internal components of the device. The external cover 116 may comprise any appropriate inlets, outlets, holes, slits, and openings suitable for allowing for the desired functionality of the device.

In one embodiment the programmable weight movement tracking device may further comprise a proprietary software. The action of the device may be controlled electronically, and a proprietary software may be implemented to program or command when the device is activated, how the device is calibrated, how the device performs calculations, or any other appropriate parameter. By this programming the device can be instructed when to start and stop, when to perform its desired functions, and when to fail safe in the event of an emergency or in response to specific parameters.

The programmable weight movement tracking device may further comprise a control panel. The control panel may further comprise a display device, a reset switch, and a plurality of indicators. The reset switch may comprise any appropriate switch such as, for example, a single pole single throw switch, a momentary switch, or a maintained switch. The plurality of indicators may comprise any appropriate indicators such as, for example, light bulbs or light-emitting diodes. The plurality of indicators may indicate to a user various status elements of the device such as, for example, whether the device is on or off or whether the control panel is wirelessly connected to a central database.

In one embodiment the programmable weight movement tracking device may further comprise an audiovisual alarm. The audiovisual alarm may comprise any alarm appropriate for indicating a status to a user. By way of example, the audiovisual alarm may comprise a plurality of lights, a plurality of speakers, a combination of lights and speakers, or other similar device. The audiovisual alarm may indicate to a user an upper or lower range of travel of the device, that the device is powered, or any other appropriate indication.

In one embodiment the programmable weight movement tracking device may further comprise a display device. The display device may comprise any appropriate digital display or interactive display, such as a high-definition liquid crystal display or a touch screen. A plurality of input devices may also be attached to the display device allowing a user to interact with the display device or the system. Such plurality of input devices may comprise, for example, a keyboard and mouse combination, a microphone, a facial recognition or gesture recognition camera, or any other appropriate input.

In an illustrated embodiment the programmable weight movement tracking device may comprise a vertical support 104 attached to a base 102. A secondary arm 112 may be telescoped over the vertical support 104, and a plurality of optical sensors 106 and an electronics bank 110 may be attached to the secondary arm 112. A top sensor 108 may be attached to an upper side of the vertical support 104. The secondary arm 112 may be locked to the vertical support 104 by a plurality of height adjusters 114, and an external cover 116 may be placed over the device to protect and cover the internal components.

The programmable weight movement tracking device may be substantially assembled by any appropriate mechanism known in the art. By way of example, the various components of the device may be attached to one another, as contemplated by the present disclosure, by screwing, gluing, welding, adhering, interlocking, clasping, binding, nailing, or any other appropriate mechanism.

The programmable weight movement tracking device may be substantially constructed of any suitable material or combination of materials, but typically is constructed of a resilient material or combination of materials such that the device is resistant to damage as a result of compression, twisting, heating, or submersion in water. As an example, and without limiting the scope of the present invention, various exemplary embodiments of the programmable weight movement tracking device may be substantially constructed of one or more materials of steel, aluminum, brass, fiberglass, carbon fiber, plastic, acrylic, polycarbonate, polyester, nylon, denim, cotton, silicone, or combinations thereof. In some embodiments the various components of the device may be coated, lined, or otherwise insulated to prevent contamination of the device. In one embodiment the material of construction may vary from one component to the next within the system.

In one embodiment the programmable weight movement tracking device may comprise a resilient material of construction that either comprises a material having antimicrobial properties or comprises a layering of antimicrobial material or coating. Antimicrobial properties comprise the characteristic of being antibacterial, biocidal, microbicidal, anti-fungal, anti-viral, or other similar characteristics, and the oligodynamic effect, which is possessed by copper, brass, silver, gold, and several other metals and alloys, is one such characteristic. Copper and its alloys, in particular, have exceptional self-sanitizing effects. Silver also has this effect, and is less toxic to users than copper. Some materials, such as silver in its metallic form, may require the presence of moisture to activate the antimicrobial properties.

To begin using the programmable weight movement tracking device the device may be placed near a cable weight machine such that the plurality of optical sensors 106 are pointed to the weight stack of the machine and the top sensor 108 may be pointed to the upper range of motion point of the weight stack. The plurality of optical sensors 106 and the top sensor 108 may be calibrated by physical manipulation of the various sensors and by control via the proprietary software of the device. By this design and calibration the plurality of optical sensors 106 may detect movement in one or more of the weight plates in the weight stack, and therefore the device may determine how much weight is being lifted, and may detect when the weight plates have been moved to their upper limit, and therefore how many exercise repetitions have been performed.

Figure 17:
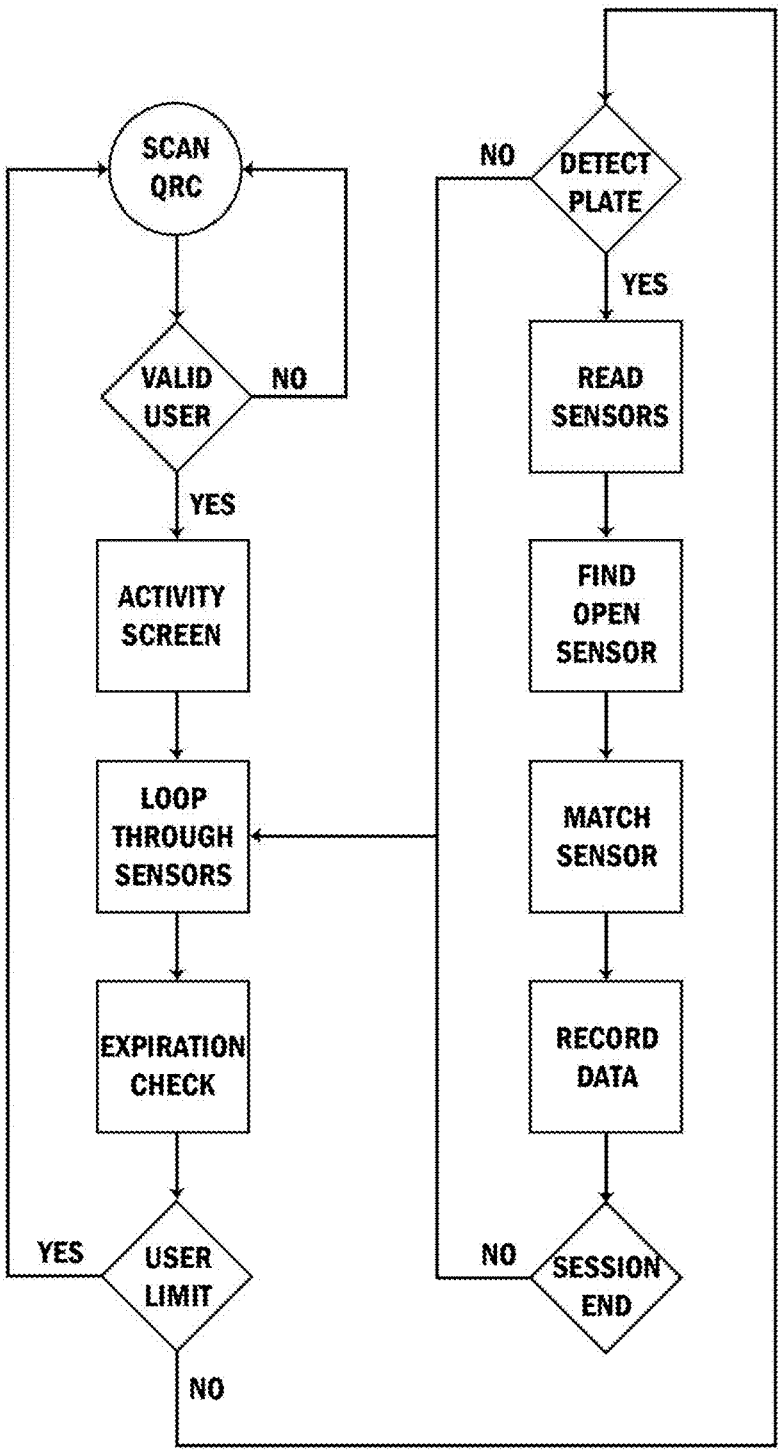
FIG. 17 schematically presents a method of using a programmable weight movement tracking device, as contemplated by the present disclosure.

The illustration of FIG. 17 schematically presents a method of using a programmable weight movement tracking device. A user may begin by creating a user account in the proprietary software of the device and may then connect to the device by any appropriate means such as, for example, logging in on the device, scanning a quick-response (QR) code associated with the device, connecting to the device via wireless technology, or any other appropriate mechanism.

The device via the proprietary software may begin by determining if the user is a valid user of the device. Once the user has been determined to be a valid user, the device or the proprietary software may present an activity screen to the user. The activity screen presented to the user may allow the user to select or start a particular exercise. The device or the proprietary software may then begin looping through the plurality of sensors 106 to detect the originating position of the various weight plates. The device or the proprietary software may then assess whether the user has reached an exercise limit for that user or that exercise.

If the user has not reached an exercise limit the device or proprietary software may then cycle through attempting to detect or not detect weight plates via the plurality of optical sensors 106 and the top sensor 108. The device or proprietary software may perform this function by detecting a weight plate via the top sensor 108 and then determining which of the plurality of optical sensors 106 no longer detect a weight plate. By this mechanism the device or proprietary software may determine the number of exercise repetitions the user has performed and the amount of weight being lifted by the user. The device or proprietary software may then record or update these parameters and record them to a central database. Upon reaching a user or exercise limit the device or proprietary software, or the user, may end the exercise session.

Figure 18:
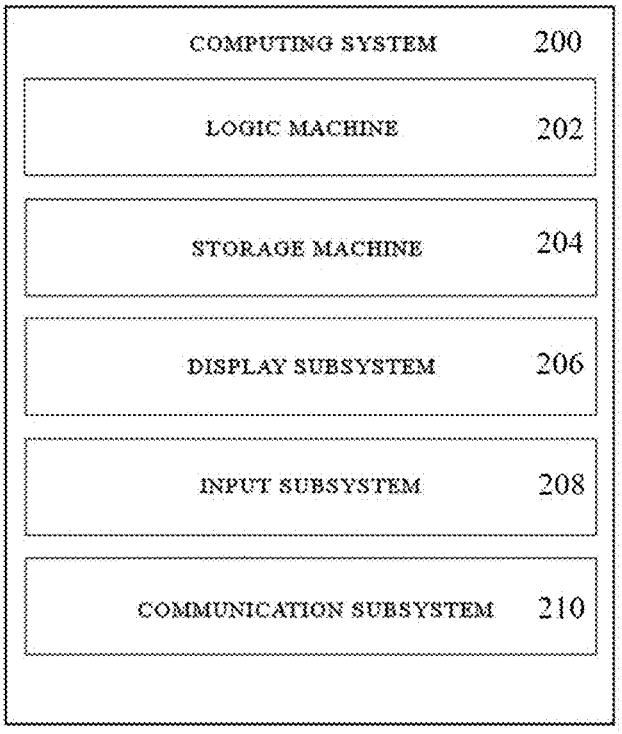
FIG. 18 schematically presents a computing system of a programmable weight movement tracking device, as contemplated by the present disclosure.

The illustration of FIG. 18 schematically presents a process algorithm that may represent an embodiment of the present invention. In some embodiments the method is executed on a computing system such as computing system 200. For example, storage machine 204 may hold instructions executable by logic machine 202 to provide the method to users. Display subsystem 206 may display the various elements of the method to participants. For example, display subsystem 206, storage machine 204, and logic machine 202 may be integrated such that the method may be executed while being displayed on a display screen. The input subsystem 208 may receive user input from participants to indicate the various choices or user inputs described above.

The described method may be executed, provided or implemented to a user on one or more computing devices via a computer-program product such as via an application programming interface (API). The illustration of FIG. 18 schematically shows a non-limiting exemplary embodiment of a computing system 200 that can enact the method described above. Computing system 200 may be any appropriate computing device such as a personal computer, tablet computing device, gaming device or console, mobile computing device, etc. Computing system 200 may include a logic machine 202 and a storage machine 204. Computing system 200 may include a display subsystem 206, input subsystem 208, and communication subsystem 210. Logic machine 202 may execute machine-readable instructions via one or more physical devices. For example, the logic machine 202 may be configured to execute instructions to perform tasks for a computer program. The logic machine may include one or more processors to execute machine-readable instructions. Storage machine 204 includes one or more physical devices configured to hold or store instructions executable by the logic machine to implement the method. When such methods and processes are implemented, the state of storage machine 204 may be changed to hold different data. For example, storage machine 204 may include memory devices such as various hard disk drives, compact discs (CD), or digital video disc (DVD) devices. Display subsystem 206 may visually present data stored on storage machine 204. For example, display subsystem 206 may visually present data to form a graphical user interface (GUI). Input subsystem 208 may be configured to connect and receive input from devices such as a mouse, keyboard, or gaming controller. Communication subsystem 210 may be configured to enable system 200 to communicate with other computing devices. Communication subsystem 210 may include wired and/or wireless communication devices to facilitate networked communication.

While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the appended claims.

I claim:

1. A programmable weight movement tracking device, comprising:

a base;

a vertical support;

a plurality of optical sensors; and an electronics bank;

wherein said vertical support is attached to said base;

wherein said plurality of optical sensors are attached to said vertical support; and wherein said electronics bank is attached to said vertical support.

2. The programmable weight movement tracking device of claim 1, further comprising:

a top sensor;

wherein said top sensor is attached to said vertical support.

3. The programmable weight movement tracking device of claim 2, further comprising:

a secondary arm; and a plurality of height adjusters;

wherein said secondary arm telescopes over said vertical support;

wherein said plurality of height adjusters removably attach said secondary arm to said vertical support;

wherein said plurality of optical sensors are attached to said secondary arm; and wherein said electronics bank is attached to said secondary arm.

4. The programmable weight movement tracking device of claim 3, further comprising:

an external cover.

5. The programmable weight movement tracking device of claim 4, further comprising:

a proprietary software.

6. The programmable weight movement tracking device of claim 5, further comprising:

a control panel.

7. The programmable weight movement tracking device of claim 5, further comprising:

an audiovisual alarm.

8. The programmable weight movement tracking device of claim 5, further comprising:

a display device.

9. A method for using a programmable weight movement tracking device, comprising:

calibrating a plurality of optical sensors to a cable machine weight stack;

calibrating a top sensor to a cable machine weight stack upper limit;

beginning an exercise;

determining a movement of weights by a triggering of said top sensor;

determining a number of weights moved by a plurality of signals from said plurality of optical sensors;

calculating an amount of weight lifted and a number of repetitions performed; and updating a user profile with said calculated amount of weight lifted and said calculated number of repetitions performed.

* * * * *